United States Patent [19]

Prihoda

[11] Patent Number: 4,930,556

[45] Date of Patent: Jun. 5, 1990

[54] LAY-UP FOR LAMINATED-VENEER-LUMBER

[75] Inventor: Peter J. Prihoda, Burnaby, Canada

[73] Assignee: Compax Engineering & Development Ltd., Burnaby, Canada

[21] Appl. No.: 202,791

[22] Filed: Jun. 3, 1988

[51] Int. Cl.[5] ..... B27D 1/10; B27L 5/02

[52] U.S. Cl. ..... 144/347; 144/209 R; 144/352; 144/355; 144/365; 144/367; 144/369; 156/255; 156/258; 156/264; 156/266; 156/304.5

[58] Field of Search ..... 156/304.5, 258, 266, 156/264, 193, 255, 512, 558, 559; 144/346, 347, 352, 355, 209 B, 209 C, 209 R, 365, 367, 369, 359; 428/57, 58, 60

[56] References Cited

U.S. PATENT DOCUMENTS 1,222,616 4/1917 Forsyth ..... 144/346
1,924,240 4/1930 Harwell ..... 144/347
2,382,208 1/1945 Corbin ..... 144/355
4,608,106 8/1986 Lahtinen ..... 156/258

FOREIGN PATENT DOCUMENTS 45-8113 3/1970 Japan ..... 156/304.5

*Primary Examiner*—Michael Wityshyn
*Attorney, Agent, or Firm*—Chernoff, Vilhauer, McClung & Stenzel

[57] ABSTRACT

This invention relates to a process of preparing a novel form of laminated-veneer-lumber. More particularly, this invention pertains to a process of producing a laminated-veneer-lumber which is composed of compactly arranged veneer sheets which have sinusoidal edges. A method of joining sheets of veneer in a layup, useful for continuous production of laminated veneer-lumber, comprising dispensing the stress concentration of the joints over an extended area of the joint by using veneer sheets that have opposite edges cut in a sinusoidal pattern.

8 Claims, 5 Drawing Sheets

LAY-UP FOR LAMINATED-VENEER-LUMBER

FIELD OF THE INVENTION

This invention relates to a process of preparing a novel form of laminated-veneer-lumber. More particularly, this invention pertains to a process of producinq a laminated-veneer-lumber which is composed of compactly arranged veneer sheets which have sinusoidal edges.

BACKGROUND OF THE INVENTION

Laminated-Veneer-Lumber (LVL) (sometimes called Parallel Laminated-Veneer) is a lumber-like product belonging to the family of man-made wood composites. It is produced by laminating rotary-peeled veneer sheets into billets of desired thickness, width and, generally, of continuous length. The billets are further processed into required dimensional sizes. The product has a strong resemblance to plywood, but there are noticeable differences. LVL is produced in thicker panels and of continuous length. In LVL, all veneer sheets are assembled with the grain orientation parallel to the longitudinal axis of the panel to maximize the finished product's strength in the longitudinal direction. Such an arrangement makes the LVL suitable as a direct substitute for structural lumber.

An LVL product has some important advantages over sawn natural lumber. It can be produced in sizes difficult or impossible to obtain in solid wood. It retains the wood's machinability qualities but gains improved uniformity of mechanical properties. Another important attribute of LVL is that an increased yield from a long can be obtained. Peeling utilizes the whole long thereby leaving only the core for further processing. A recovery increase of 40% to 50%, when compared to sawn lumber, has been reported and is due mainly to elimination of losses due to sawinq. Dependable design strength is achieved by randomizing the concentrated defects inherent in wood throughout the volume of the product and thereby minimizing their effect on the strength.

Notwithstanding the foregoing important advantages, LVL production processes introduce certain variables which have a detrimental effect on the product's strength. Veneer jointing is one such variable. Existing systems for production of LVL use the same or similar veneer preparation methods as those that have been developed in the past for plywood manufacture. The veneer is rotary-peeled from the circumference of a log in thicknesses most commonly ranging from 1/10" to ¼". Such peeler logs are usually eight feet long. The peeled ribbon of veneer is unrolled and subsequently clipped into planar sheets and dried. Since LVL products are manufactured in lengths exceeding that of a veneer sheet, the veneer sheets must be joined to form the desired lay-up length. The type of joint that is used in the lay-up therefore has a significant impact on the product's overall strength. Veneer joints that are currently in use in lay-up production are (a) butt, (b) overlap, (c) scarf, or (d) vertical finger joint. The butt and overlap joints are the simplest and most economical to produce, but they also suffer significant loss of strength of the finished product due to discontinuity and created stress concentrations. The strength loss associated with the scarf and vertical finger joints is less than with the butt and overlap joints. However, the scarf and finger joints are more expensive to produce. An additional operation is involved in each case, and this operation is necessarily accompanied by a waste of raw material.

Three United States patents disclose processes for producing jointed veneer products.

Forsyth (U.S. Pat. No. 1,222,616) discloses rotary-peeled veneer sheets which are subsequently cut and assembled to form a layered structure.

Harwell (U.S. Pat. No. 1,924,240) discloses a method of making compound lumber. The method includes edge-wise joining of strips of wood by mating curved edges.

Corbin (U.S. Pat. No. 2,382,208) discloses a method of making a structural element by cutting stock to produce sinuous cuts with subsequent reassembly of the cut sections.

None of these patents discloses cutting veneer sheets with sinusoidal edges using a log with angled ends.

SUMMARY OF THE INVENTION

The invention pertains to a method of joining sheets of veneer in a lay-up, useful for continuous production of laminated-veneer-lumber, comprising dispensing the stress concentration of the joints over an extended area of the joint by using veneer sheets that have opposite edges cut in a sinusoidal pattern. The method of creating a sinusoidal pattern on opposing edges of a veneer sheet, rotarypeeled from a log, comprises peeling the veneer from a log which has the ends thereof cut at an oblique angle.

The invention also pertains to a method of constructing laminated-veneer-lumber which comprises rotary-peeling veneer sheets from a log which has the ends thereof cut at an oblique angle and laminating a plurality of the peeled veneer sheets together using an overlap joint lay-up. In the method, the locations of the sinusoidal lay-up joints are staqqered relative to one another.

The invention also pertains to a method of forming a laminated-veneer-lumber comprising: (a) rotary-peeling a plurality of veneers from a plurality of logs which have their ends cut at an oblique angle; and (b) laminating the plurality of veneers together utilizing a suitable adhesive.

In the method, the angle of the log ends can be about 15° to 45° to the square cut of the log. The joints between the laminated veneers can be bevelled edge.

In another embodiment, the invention is directed to a method of forming a butt joint lay-up, comprising: (a) slitting veneer sheets in two halves through the interiors of the sheets, which sheets have at least the opposite edges thereof cut according to a variable pitch wave form, common to all sheets used in the same lay-up and originating at the same location relative to one edge of the veneer sheet; (b) interchanging the two halves of each slit veneer sheet such that the original outside wave form edge becomes an interior edge and the interior slit edges become exterior edges; and (c) forming a lay-up by buttjoininq the interior wave form ends of the veneer sheets.

DRAWINGS

The following drawings depict embodiments of the prior art and the invention but should not be regarded as restricting the spirit or scope of the invention in any way.

FIGS. 1*a*, 1*b*, 1*c* and 1*d* depict in perspective view the constructions of butt, overlap, scarf and vertical finger formats which are in commercial use.

Figure 8:
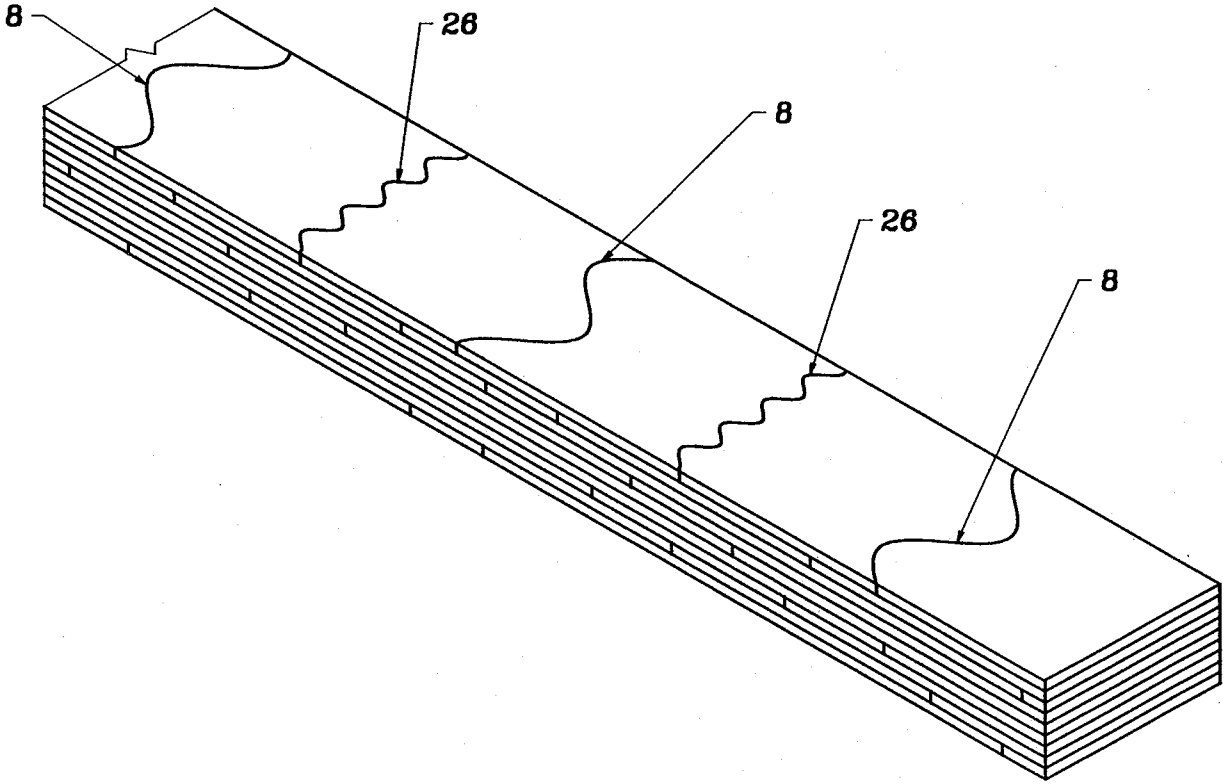

FIGS. *7a*, *7b*, *7c* and *7d* depict perspective sequential views of a full sheet with opposing sinusoidal edges being laterally constant pitch wave split in the interior and re-assembled into a sheet with a sinusoidal edge in the interior; and FIG. 8 illustrates a lay-up plank formed of a sinuous butt joint lay-up according to the procedure in FIGS. *7a*, *7b*, *7c* and *7d*.

DETAILED DESCRIPTION OF SPECIFIC EMBODIMENTS OF THE INVENTION

Of the four straight line joint types mentioned above and illustrated in FIGS. 1*a*, 1*b*, 1 c and 1*d*, namely, butt, overlap, scarf and finger, the butt joint consistently has the lowest inherent strength. The overlap joint type is stronger but its strength is below the strength of test beams having no joints. The lower strength is caused by the defect each of these joints creates. For discussion purposes, a joint may be thought of as a single straight line discontinuity, generally in the direction perpendicular to the longitudinal axis of the structural member.

In the matrix of a beam, such a discontinuity decreases the effective load-bearing cross-sectional area and acts as a stress concentration point. The result is a diminished load-carrying or absorbing capacity of the structural member. The undesirable strength reducing effects of joints can be minimized to a certain extent by distributing the in-line concentrated void over an area of each lamina, thereby reducing the localized stress concentration points. If a joint is constructed by using components which have been cut at an oblique angle rather than a right angle to the longitudinal axis of the member, the stress load distribution is spread over a larger area. The overall weakening effect of the joint is thereby reduced.

An approach which is useful in evaluating the effect of an oblique angle on a joint's performance is to consider the cross-section of which the joint is a part. Should the failure mode follow a particular oblique joint, it encounters a larger area and therefore a larger load is required to generate the same stress level at any given point. The same can be argued for any joint deviating from a straight line, or not being perpendicular to the long axis of the beam.

Figure 3:
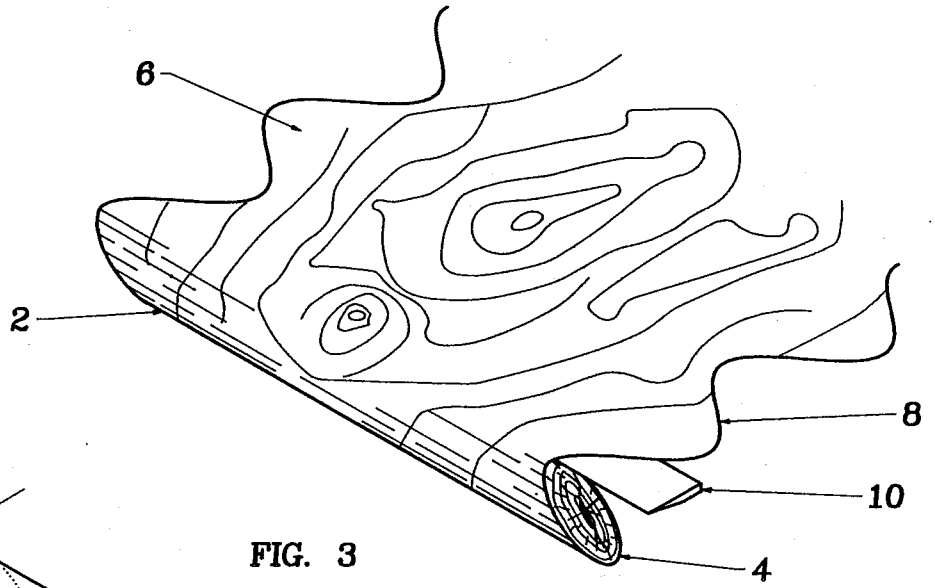
FIG. 3 depicts in perspective view a veneer sheet with a sinusoidal edge that is obtained by peeling a log with its ends cut at oblique angles.
Figure 2:
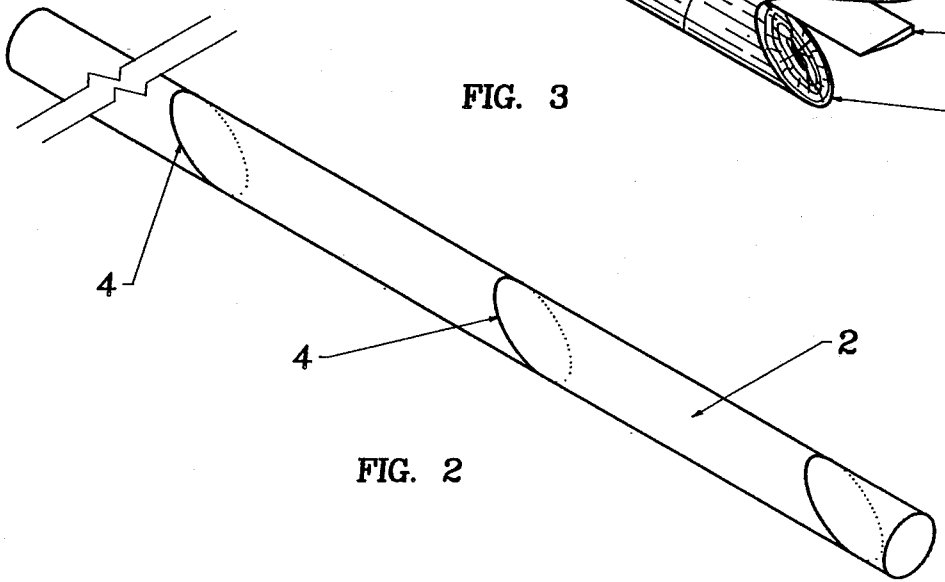
FIG. 2 depicts in perspective view a log which has been cut at an oblique angle at various spaced locations.

The jointing method disclosed herein accomplishes the joint defect dispersion objective while at the same time minimizing waste of raw material. The deviation from a straight perpendicular joint is achieved by cutting the ends of a peeler log 2 at an oblique angle 4, as illustrated in FIG. 2. Rotary-peeling of logs 2 prepared in this way by a knife 10 produces a ribbon of veneer 6 with sinuous wave edges 8, as depicted in FIG. 3. The depth of the wave from peak to valley will depend on the angle 4 at which the log 2 had been cut. A practical limit to the angle of the cut can be expected around 45° from the square cut. The variation of the wave's pitch as a function of the log's diameter improves randomization of the joint location and joint strength when the veneer 6 is used to construct a lay-up. An additional advantage is that the edge of the joint created by this technique is bevelled, the angle varying from 90° at the inflection points of the wave to the maximum inclination at the peaks. The maximum inclination is equal to the angle at which the log 2 was cut. The bevel angle further reduces the stress concentration effect of the joint.

Once the veneer 6 with sinusoidal edges 8 is cut, then subsequent operations of the lay-up process are the same as are now used in present laminatedveneer-lumber manufacturing processes. The unrolled veneer is clipped into sheets of desired width and dried.

Two types of lay-ups can be produced using sinusoidal edge veneer that has been prepared according to the techniques of the invention.

(1) SINUOUS OVERLAP, BEVELLED EDGE OR STRAIGHT EDGE LAY-UP

Figure 4:
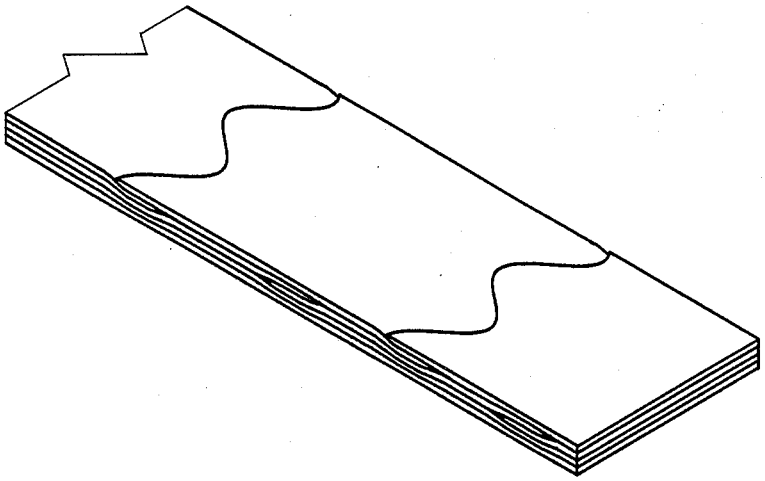
FIG. 4 depicts a perspective view of a board constructed from a plurality of veneers with sinusoidal edges to produce a sinuous overlap lay-up.
Figure 5:
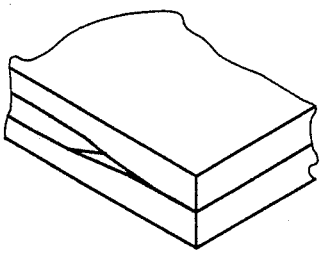
FIG. 5 depicts a perspective view of a board with a bevelled edge joint.
Figure 6:
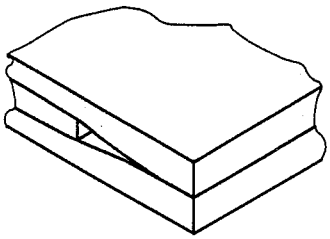
FIG. 6 depicts a perspective view of a board with a straight edge joint.
Figure 7A:
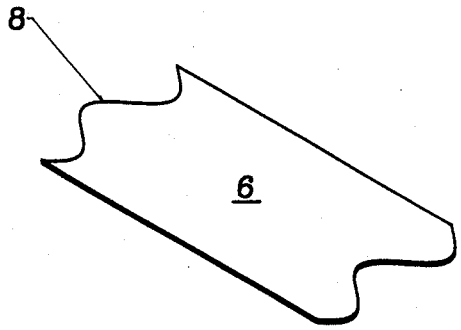
Figure 7B:
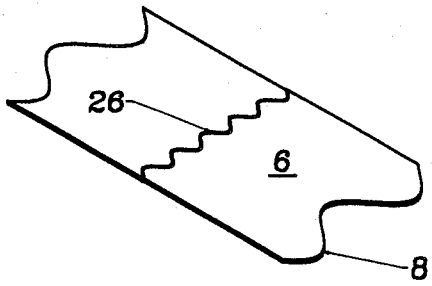
Figure 7C:
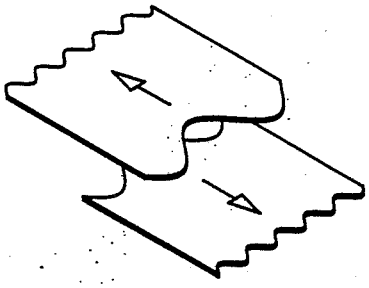
Figure 7D:
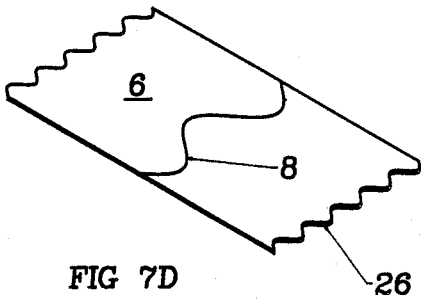

An overlap joint can be produced by overlapping the sinusoidal lead end of the upper sheet on the sinusoidal tail end of the sheet immediately below. The amount of overlap can be regulated to ensure that the qulleys of the two waves are a sufficient distance apart. The resulting overlap joints have a wavy form and have substantially increased length and strength. FIG. 4 illustrates a typical lay-up 12 with stagqered sinuous lap joints represented by lead lines 14, 16, 18 and 20. The created defect is well dispersed. The improved transition that is obtained with a bevelled veneer edge 22 is depicted in FIG. 5. A conventional non-bevelled overlap joint 24 is shown in FIG. 6. This type of joint, when constructed of veneer with a sinusoidal edge, has enhanced strength. However, the overlap joint does not have the inherent stress dispersion qualities of a bevelled edge (FIG. 5).

(2) SINUOUS BUTT JOINT LAY-UP

Figure 1A:
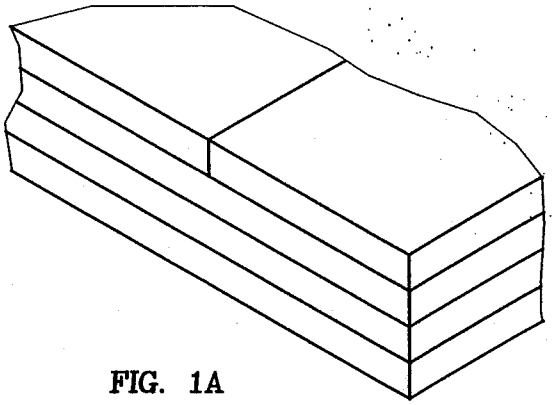
Figure 1B:
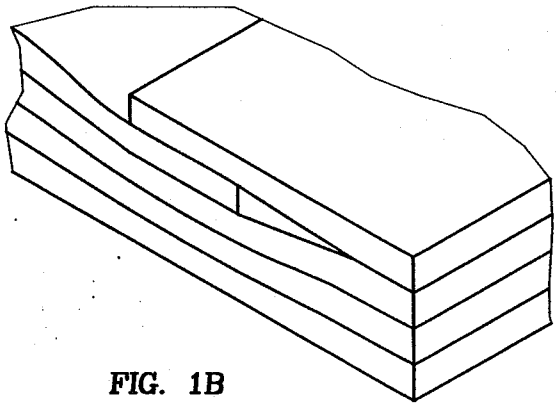
Figure 1C:
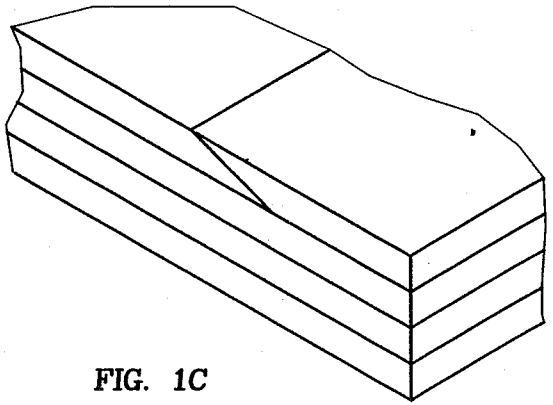
Figure 1D:
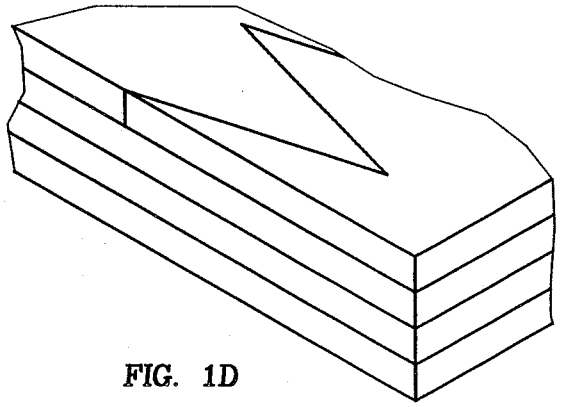

An alternative lay-up system can be created by butt-joining the sheets of veneer in a manner similar to that illustrated in FIG. 1*a*. This approach requires a close wave pitch match of the sinusoidal edges of two mating sheets of veneer. Since the pitch of the wave is a function of the log's diameter, a correct match of veneer obtained from different diameter logs is not easily produced. But, a reliably good pitch match can be obtained by joining the opposing sinusoidal edges of the same sheet of veneer. FIG. 7 illustrates in four perspective sequential views *7a*, *7b*, *7c* and *7d*, the manner in which a sheet can be split and re-assembled to produce a close wave pitch match. FIG. 8 illustrates in perspective view the sinuous butt joint lay-up that can be produced using this technique. In using this method, it is important to trim the ends 4 of the log 2 at the same angle and in the same direction. The close matching is accomplished by further splitting each sheet of veneer 6 in a direction perpendicular to the grain by punching a laterally extending sinusoidal, or a similar zig-zag, cut 26 through the interior region of the sheet 6, preferably through its center. Since the new wave 26 will be cut by the same tool in each sheet, any two sheets can be jointed in a layup. The resulting joint will be similar in a sense to a finger joint. In order to position the newly-cut constant wave pattern 26 on the outside edges of each sheet, the halves of individual sheets 6 are interchanged such that the original exterior variable pitch waves 8 form the interior sheet joint. Since these waves 8 were cut on the same log radius, they will correctly or approximately match.

The rotary-peeling of bevelled logs according to the invention can be simplied if a spindleless lathe is used. Since, in this case, the ends of the bolts are not used to drive the log, no additional considerations need to be applied.

The boards of sheets formed according to the process of the invention have the following distinctive characteristics and advantages over other known systems.

1. The new joint has a sinuous pattern and is produced during the veneer peeling operation, thereby avoiding the need to add another step to the process.

2. The secondary wavy split of a veneer sheet is produced without any appreciable loss of raw material.

3. A sinuous edge joint disperses the stress more than is possible with a straight load defective straight edge.

4. The sinuous edges are produced during the peeling operation of a log with bevelled edges, thereby producing a bevelled sinusoidal veneer edge that has enhanced stress distribution properties.

As will be apparent to those skilled in the art in light of the foregoing disclosure, many alterations and modifications are possible in the practice of this invention without departing from the spirit of scope thereof. Accordingly, the scope of the invention is to construed in accordance with the substance defined by the following claims.

I claim:

1. A method of creating a sinusoidal pattern on opposing edges of a veneer sheet rotary-peeled from a log, which comprises peeling the veneer sheet from a log which has the ends thereof cut at an oblique angle to the square cut of the log.

2. A method of constructing an overlap joint which comprises using sheets of veneer produced by the method according to claim 1 whereby one of the sinusoidal pattern opposing edges of a veneer sheet is positioned between the sinusoidal pattern opposing edges of a veneer sheet below it.

3. A method of constructing laminated-veneer-lumber which comprises rotary-peeling veneer sheets from a log which has the ends thereof cut at an oblique angle to the square cut of the log and laminating a plurality of the peeled veneer sheets together using an overlap joint lay-up.

4. A method according to claim 3 wherein the locations of the joint log-ups are staggered relative to one another.

5. A method of forming a laminated-veneer-lumber comprising:

(a) rotary-peeling a plurality of veneer sheets from a plurality of logs which have their ends cut at an oblique angle to the square cut of the logs to thereby form sheets with opposing sinusoidal bevelled edges;

(b) stacking the plurality of veneer sheets so that the opposing sinusoidal bevelled edges of the veneer sheets in each layer of the stack are not aligned with one another; and (c) laminating the plurality of veneer sheets together utilizing a suitable adhesive.

6. A method according to claim 3 or 5 wherein the angle of the log ends is about 15° to about 45° to the square cut of the log.

7. A method of forming a butt joint lay-up, comprising:

(a) slitting veneer sheets into two respective halves through the interiors of the sheets to form interior slit edges, which sheets before splitting have at least the opposite exterior edges thereof cut according to a wave form common to all unslit sheets used in the same layup and originating at the same location relative to one edge of the veneer sheet;

(b) interchanging the two halves of each slit veneer sheet such that the original exterior wave form edges become abutting interior wave form edges; and (c) forming a lay-up by butt joining together the abutting interior wave form edges of the veneer sheets.

8. A method of constructing a wood composite by forming a butt joint lay-up, comprising:

(a) preparing sheets of veneer by rotary-peeling logs which have the ends thereof cut at a common parallel oblique angle to the square cut of the logs;

(b) slitting the veneer sheets into halves through the interiors of the sheets, the slit having a shape of a constant pitch wave;

(c) interchanging the two halves of each slit veneer sheet such that the original exterior edges produced by peeling are coupled in the interior of a newly formed sheet and the two constant pitch wave edges formed by slitting the sheets become the respective exterior edges of the newly formed sheet; and (d) butt joining the newly formed sheets in a lay-up.

* * * * *